US006766677B1

(12) United States Patent
Turnbull

(10) Patent No.: US 6,766,677 B1
(45) Date of Patent: Jul. 27, 2004

(54) DIE CURL ASSEMBLY

(75) Inventor: Robert D. Turnbull, Massillon, OH (US)

(73) Assignee: Stole Machinery, Inc., Canton, OH (US)

( * ) Notice: Subject to any disclaimer, the term of this patent is extended or adjusted under 35 U.S.C. 154(b) by 0 days.

(21) Appl. No.: 10/377,000

(22) Filed: Mar. 3, 2003

(51) Int. Cl.[7] ..... B21D 51/44
(52) U.S. Cl. ..... 72/348; 72/466.9
(58) Field of Search ..... 72/348, 466.9

(56) References Cited

U.S. PATENT DOCUMENTS 4,516,420 A 5/1985 Bulso, Jr. et al. ..... 72/329
4,549,424 A 10/1985 Bulso, Jr. et al. ..... 72/329
4,574,608 A 3/1986 Bulso, Jr. et al. ..... 72/348
4,587,825 A 5/1986 Bulso, Jr. et al. ..... 72/329
4,624,125 A 11/1986 Bulso, Jr. et al. ..... 72/453.13
4,800,743 A * 1/1989 Bulso et al. ..... 72/336
4,862,722 A * 9/1989 Fraze et al. ..... 72/336
4,977,772 A 12/1990 Bulso, Jr. et al. ..... 72/336
5,881,593 A 3/1999 Bulso, Jr. et al. ..... 72/336
6,089,072 A * 7/2000 Fields ..... 72/379.4

* cited by examiner

*Primary Examiner*—Lowell A. Larson
(74) *Attorney, Agent, or Firm*—Renner, Kenner, Greive, Bobak, Taylor & Weber

(57) ABSTRACT

Apparatus for forming container shells from material fed into a press, including, at a single station, tooling for curling the shell and tooling for forming or reforming the shell including a punch assembly and a die assembly carried by the press adapted to curl and form or reform the shell in a single stroke.

20 Claims, 10 Drawing Sheets

DIE CURL ASSEMBLY

RELATED PATENT APPLICATIONS

None.

FIELD OF THE INVENTION

The present invention generally relates to a rotary die curl assembly for forming container end panels, commonly called shells, from a sheet of material. More particularly, the present invention relates to a rotary die curl assembly capable of curling and reforming an end in a single rotary press.

BACKGROUND OF THE INVENTION

The forming of ends or shells for containers is well-known in the art. Representative patents disclosing end forming include Bulso U.S. Pat. Nos. 4,516,420 and 4,549,424. Similarly, devices have been developed to perform reforming and curling operations. Representative examples of these operations may be found in Bulso U.S. Pat. Nos. 4,587,825 and 4,574,608. At least one device has combined the curling and reforming steps in a single press. But, in that device, the end must travel to separate curling and reforming stations. The necessity of having multiple stations increases the size and complexity of the machine. Consequently, a need has existed in the art for a press that can combine the curling and forming or reforming steps in a single station.

SUMMARY OF THE INVENTION

Accordingly, an object of the present invention is to combine the reforming and curling steps in a single rotary die curl assembly.

It is also an object of the present invention to provide means for compensating for the thermal expansion of the press during operation.

In light of at least one of the foregoing objects, the present invention provides a rotary die curl assembly including a punch assembly and a die assembly axially aligned and selectively engageable with each other. The punch assembly includes a punch holder mounted on a punch center post. The punch holder haves an annular end that extends toward the die assembly where the end has an axially inward and radially inward extending tips. A curling punch is received within the punch holder. A punch core mounted within the curling punch and includes an axially extending periphery located adjacent to the curling punch and defining a recess therebetween. The curling punch extends axially outward of said punch holder and said punch core. The die assembly includes a curling die received within a die holder and defining a bore. A lower pressure is mounted within the bore and slideable relative to the curling die. A die core is located within the lower pressure pad and has a raised edge located beneath the recess in said punch assembly. An upper spring holder is located below the curling die, the lower pressure pad, and the die core supporting at least one of the curling die, lower pressure pad and die core, and a lower spring holder is located below the upper spring holder and held in spaced relation therefrom by a spacing assembly defining a gap between said upper spring holder and said lower spring holder whereby thermal expansion of either of the punch assembly or die assembly is compensated for by the spacing assembly and the gap.

The present invention further provides an apparatus for forming container shells from material fed into a press, including at a single station, tooling for curling the shell and tooling for forming or reforming the shell including a punch assembly and a die assembly carried by the press adapted to curl and form or reform the shell in a single stroke.

BRIEF DESCRIPTION OF THE PREFERRED EMBODIMENTS

Figure 1:
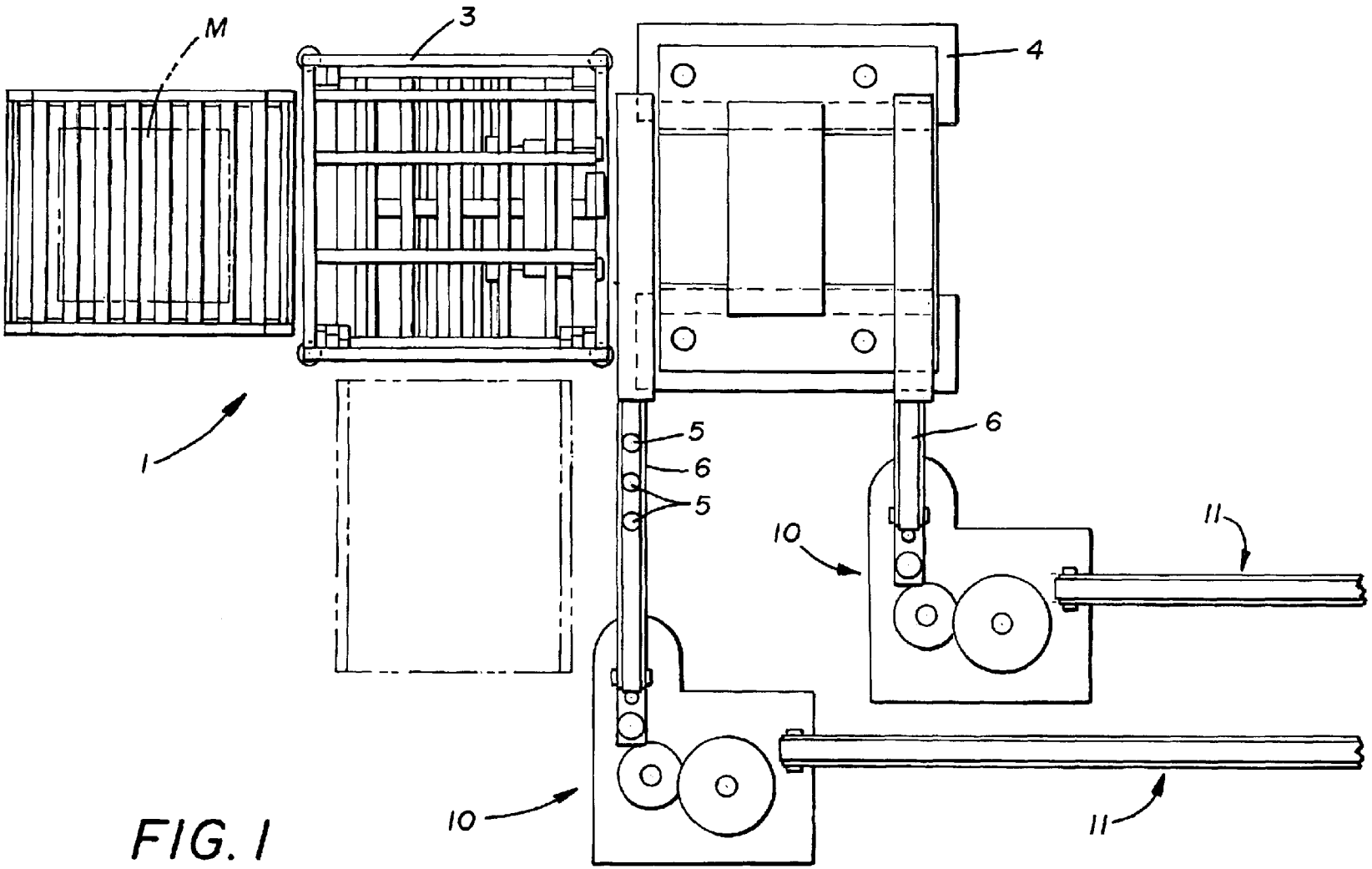
FIG. 1 is a top plan view of an end press system according to the concepts of the present invention.
Figure 2:
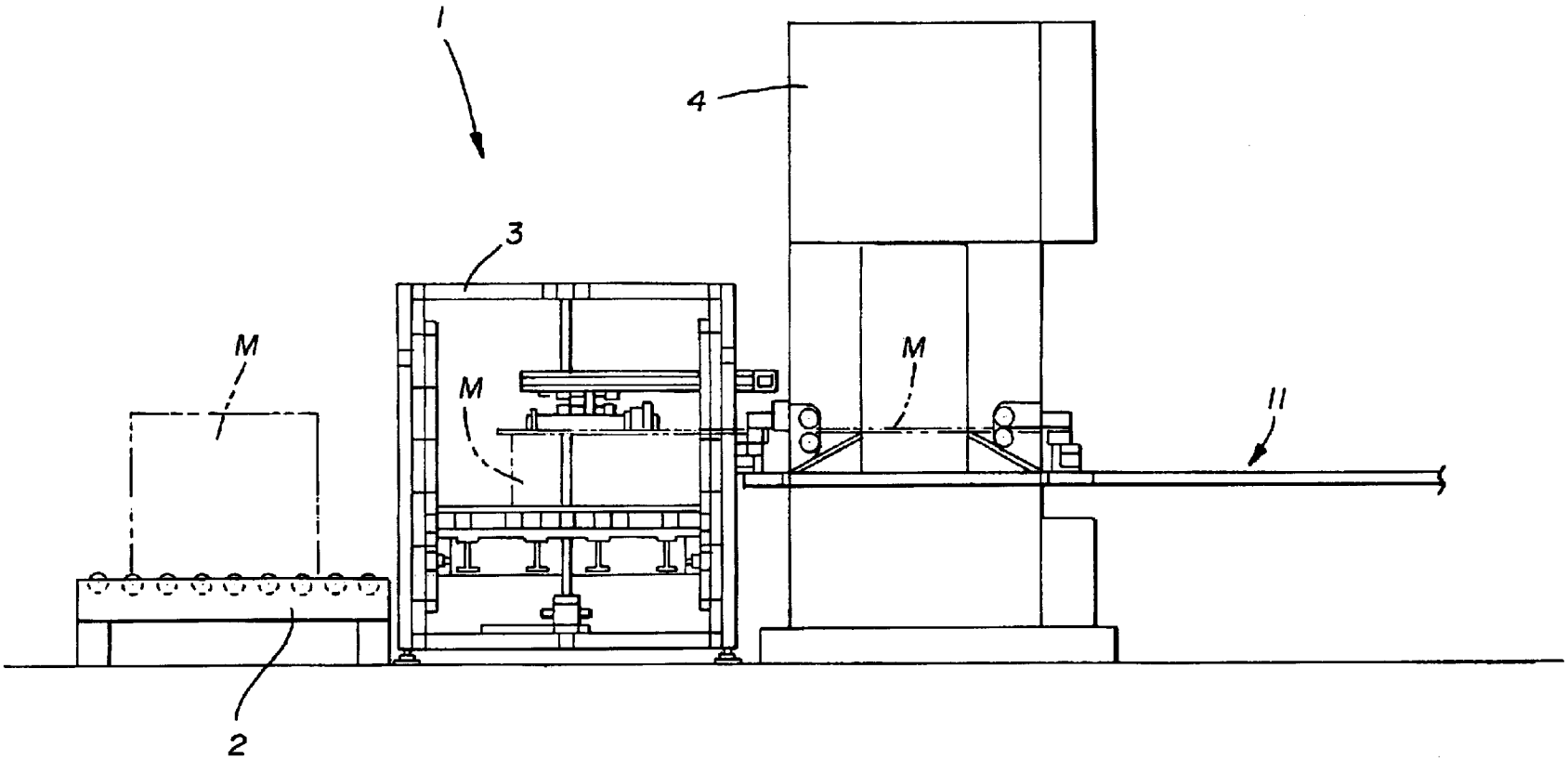
FIG. 2 is a front elevational view thereof.

An overview of an end press system, generally indicated by the numeral 1, is depicted in FIGS. 1 and 2. The end press system 1, may generally include a motorized pallet conveyor that carries plural sheets of material M that are subsequently loaded onto a lift table 3, where individual sheets of material M are fed into an end forming machine 4. It will be appreciated that a coiled supply of material M may be fed into the end forming machine 4 as an alternative to sheets of material M. Within the end forming machine 4, the material M is first blanked and carried on a blanking punch to a second level where it is formed into a shell 5 either by a full form or standard process. During the process, the forming punch and the die center meet through the material and over travel to maintain shell specification. After shell formation, the shell 5 is ejected, as by air or a mechanical kicker, onto a conveying system 6, that separates and equally spaces the ejected shells 5, as by variable conveying, a star wheel separator, or other means known in the art. From the conveyor 6, shells 5 are delivered to the end feed of one or more rotary die curl machines, generally indicated by the numeral 10. The shell 5 is provided with a curl in the rotary die curl machine 10, as discussed in more detail below, and subsequently directed down stream at 11 for further processing, as necessary.

Figure 3:
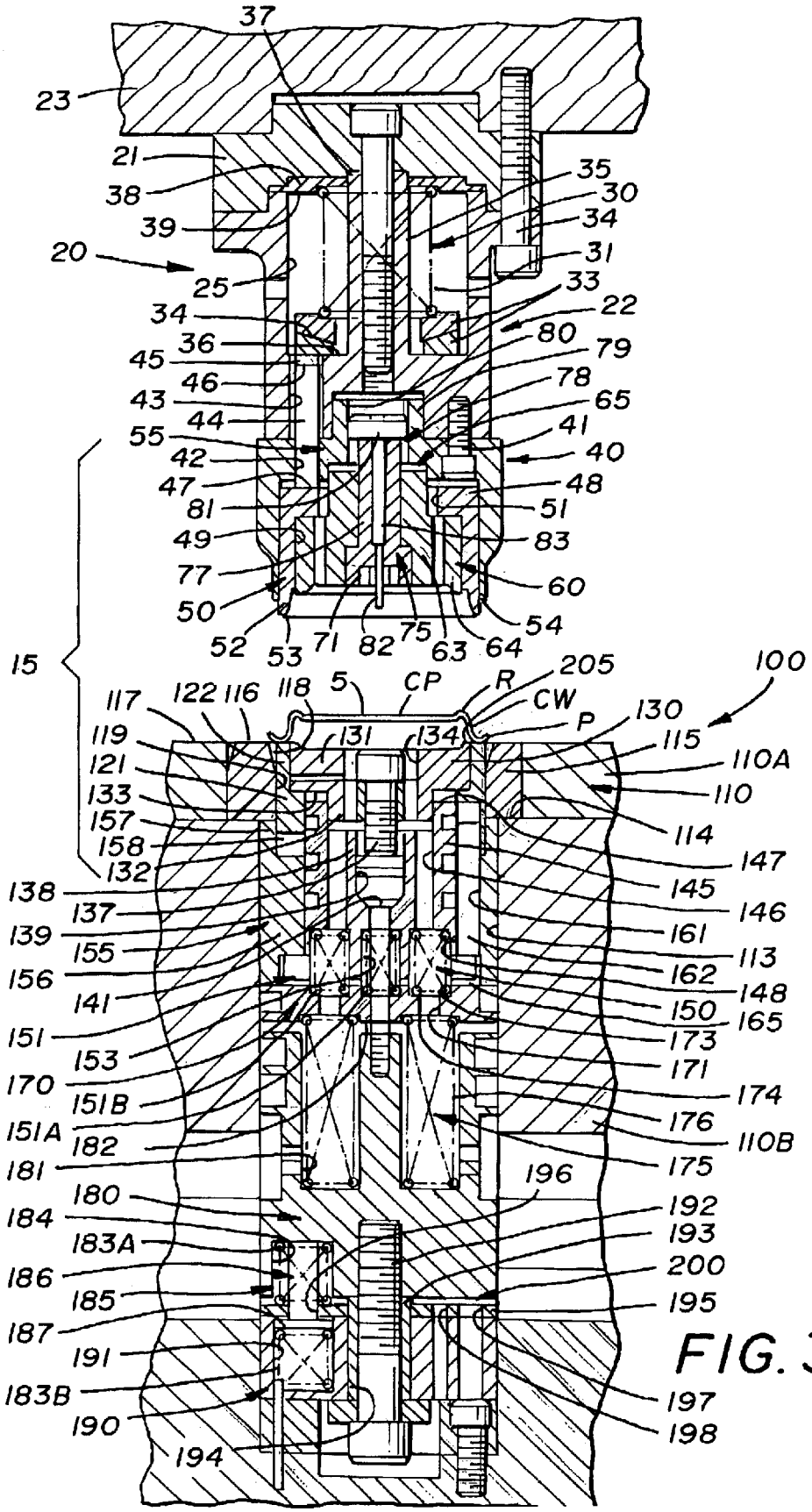
FIG. 3 is a sectional side elevational view of a rotary die curl assembly according to the concepts of the present invention.

A die curl assembly, generally indicated by the number 15 in FIG. 3, is located within the rotary die curl machine 10. As discussed previously, the shell 5 enters the rotary die curl machine 10 and is provided on the rotary die curl assembly 15, as shown in FIG. 3. As can be seen in FIG. 3, the shell 5 may enter the rotary die curl assembly 15 having been formed to include a central plate CP, a ridge R about the periphery of the central plate CP, a chuck wall CW extending downwardly from the ridge R and an upturned peripheral edge P extending from the chuck wall CW. The peripheral edge P or hook is curled within the die curl assembly 15, as will be described in more detail below.

Rotary die curl assembly 15 includes a punch assembly 20 and a die assembly 100 that carry tooling for the curling and reforming of the shell 5. Punch assembly 20 includes a punch cap 21 on which the punch center 22 is mounted. Punch cap 21 and punch center 22 are, in turn, attached to a punch riser 23 as by a fastener 24. As will be understood, the punch riser 23 is movable in the axial direction to urge the punch center 22 toward and away from the die assembly 100, as will be described more completely below.

As best shown in FIG. 3, punch center 22 defines a cavity 25 at its upper extremity that receives a punch biasing assembly, generally indicated by the numeral 30. Punch biasing assembly 30 may include one or more springs, such as, a coil spring 31. As an alternative or in addition to spring 31, beveled washers 33 may be used to the same effect. In the example shown, the beveled washers are constructed of spring steel to enhance the spring-like effect created by the beveled washers 33. As shown, a pair of beveled washers may be placed on top of each other in an opposing relationship such that their beveled surfaces 34 are in an opposed sloping relation causing the washers 33 to contact each other about substantially their entire surfaces 34. Moreover, in this configuration, washers 33 present level outer surfaces for interacting with spring 31 and pin 44, described below.

A cylindrical bushing 35 may be located centrally within the cavity 25 to facilitate location and mounting of the punch biasing assembly 30. In the example shown, bushing 35 is integrally formed with the center post 22 extending axially upwardly from a floor 36 of cavity 25 into a bushing recess 37 defined within the punch cap 21. A shallower recess 38 is similarly defined in punch cap 21 to receive a spring spacer 39 that fits over bushing 35 and punch biasing assembly 30 to enclose the biasing assembly 30 within the cavity 25.

A punch holder, generally indicated by the numeral 40 may be attached at the lower extremity of punch center 22, as by a fastener 41. Punch holder 40 defines a bore 42 that shares a common axis with a bore 43 formed in the punch center 22. The bores 42, 43 are axially aligned and a pin 44 is received therein and has a length slightly less than the length of the two bores such that a gap 45 exists between the end 46 of the pin 44 and the floor of cavity 25. The opposite end 47 of pin 44 rests on an annular shoulder 48 of a curling punch, generally indicated by the numeral 50, that resides within a curling punch cavity 49 defined by the punch holder 40.

Figure 3A:
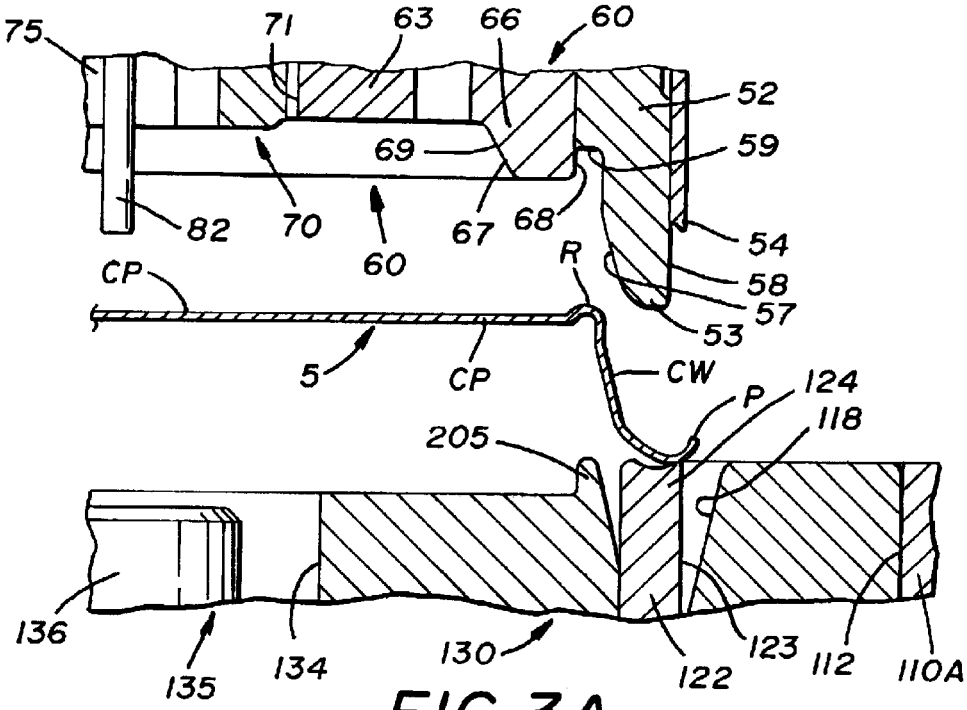
FIG. 3A is an enlarged view of a portion of FIG. 3 depicting the punch and die assemblies of the rotary die press in a separated condition with a shell located at the interface of the assemblies prior to reforming and curling.

As mentioned curling punch 50 includes an annular shoulder 48 located coaxially with the punch holder 40 and defining a bore at 51 adapted to receive a punch core, generally indicated by the numeral 55 and described more completely below. Curling punch 50 further includes a generally cylindrical punch member 52 that extends axially outward from the annular shoulder 48. In the position depicted in FIG. 3, the tip 53 of punch member 52 extends beyond the end 54 of punch holder 40, such that, punch member 53 initiates contact with the shell 5 during the forming process. As best seen in FIG. 3A, the end 56 of punch member 52 has an axial length that conforms closely to the height of the chuck wall CW. Punch member 52 may further have an inner wall 57 that extends radially outward in the axial outward direction to the tip 53 of punch member 52 to generally conform to the slope of a preformed chuck wall CW. If punch member 52 is forming the shell 5, this inner wall 57 will define the chuck wall CW.

The tip 53 may similarly be contoured to provide the desired curvature to the peripheral edge P of the shell 5. For example, as shown in FIG. 3A, the tip 53 may curve from the interior wall 57 to the exterior wall 58 of end 56. To form or reform the ridge R, the punch member 50 may include a recess 59 defined between an upper portion 61 of inner wall 57 and an outer surface 62 of a punch core, generally indicated by the numeral 60. As shown recess 59 may be somewhat square in section to form ridge R at the edge of central plate CP.

Punch core 60 generally includes a cylindrical body portion 63 that extends axially through the bore 51 of punch 50 upwardly beyond the plane of the top surface of shoulder 48. Punch core 60 further includes a radially extending shoulder portion 64 that extends radially outward of the bore 51 below the shoulder 48 of curl punch 50, such that, the outer surface 62 of punch core 60 lies adjacent the inner surface of the curl punch 50, as best shown in FIG. 3A. In the position shown in FIG. 3, a clearance 65 is defined between the punch core 60 and the punch holder 40, such that, upward displacement of the punch core 60 relative to the punch holder 40 is permitted. At the opposite end of punch core 60, an annular flange 66 extends axially outward from the periphery of the punch core 60 to contact the center plate CP of the shell 5. Flange 66 has a generally planar and generally vertically extending outer wall 68 and a sloped interior wall 69 that defines a generally cylindrical cavity at 70. Punch core 60 further defines a stepped bore 71 (FIG. 3) adapted to receive an ejector pin assembly, generally indicated by the numeral 75.

Figure 5A:
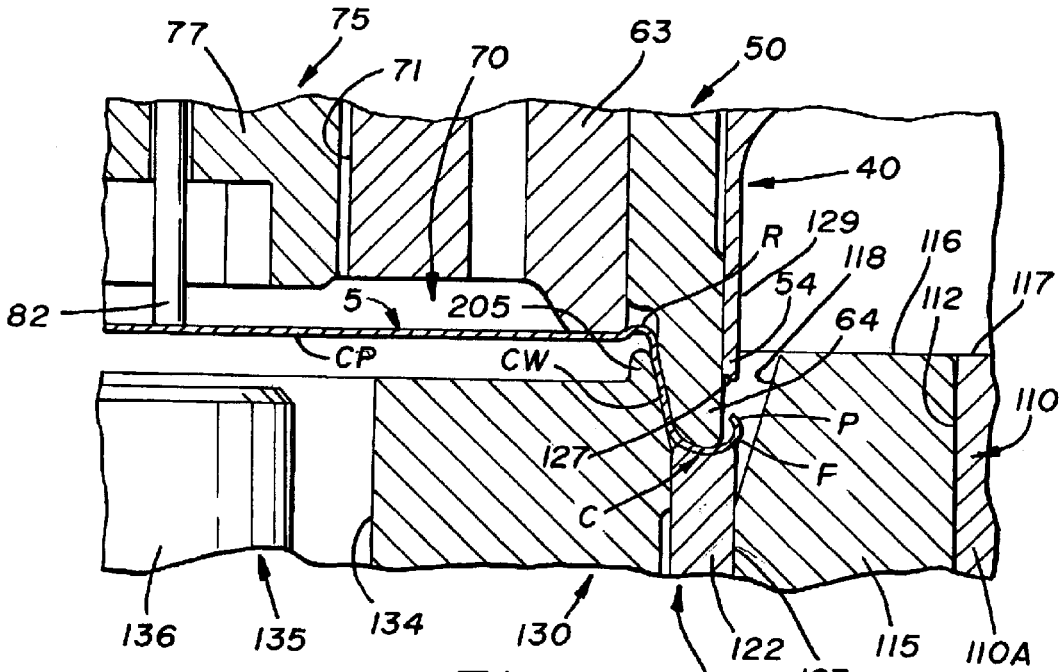
FIG. 5A is an enlarged view similar to FIG. 3A showing further details of the interface between the punch and die assemblies at the position depicted in FIG. 5 showing details of the initial curl forming process.

Ejector assembly 75 may include a vacuum assembly for removing shell 5 or a mechanical assembly, such as, the pin system described herein. To that end, ejector assembly 75 may include a sheath 77 that fits within the bore 71 defined by punch core 60 and extends axially upward beyond punch core 60 into a cavity 78 defined by an upwardly extending portion 79 of punch holder 40, which may include inwardly projecting annulus 80 that captures the upper end 81 of ejector assembly 75. A pressure activated pin 82, which extends from a cylinder 83 is slideably received within sheath 77 and includes a portion that extends axially outward into the cavity 70. As best shown in FIG. 5A, upon contacting the central plate CP, the pin 82 is driven upwardly into cylinder 83 developing a pressure within the cylinder 83 sufficient to drive the pin 82 outwardly. Upon release of the rotary die curl assembly 15 the pressurized pin 82 expands axially outward to eject the shell 5 from the punch assembly 20, as described more completely below.

The rotary die curl assembly 15 further includes a die assembly, generally indicated by the numeral 100, located opposite the punch assembly 20 and along the same axis. The punch assembly 20 and die assembly 100 interact to curl and reform the shell 5, as described more completely below. Die assembly 100 includes a die holder, generally indicated by the numeral 110. In the example shown, the die holder 110 has upper and lower sections, respectively 110A and 110B. The upper section 110A defines a bore 112 that is larger than a bore 113 defined by the lower section 110B creating a shoulder 114 upon which a curling die 115 rests. The curling die 115 is housed completely within bore 112 of upper die holder section 110A and has a top surface 116 that is coplanar with the top surface 117 of the die holder 110. Curling die 115 includes a beveled surface 118 at at least a top portion of the bore 112 defined by the curling die 115. As best shown in FIG. 3, the beveled surface 118 extends radially inward as it extends axially downward to form a inwardly tapering opening into the bore 112 and creating a recess 119. As will be described more completely below, the tapered recess 119 created by beveled surface 118 creates a clearance for the initial curling of the peripheral edge P (FIG. 5*a*) of shell 5.

A lower pressure pad, generally indicated by the numeral 120, is located radially interior of the curling die 115. Lower pressure pad 120 has a generally cylindrical configuration having a base portion 121 and an upstanding wall portion 122. The base portion 121 has a thickness greater than the wall portion 122 with the wall portion 122 extending axially upward from the base portion 121 at its radial outer extremity such that the wall portion 122 and base portion 121 share a common exterior surface 123, shown best in FIG. 3A. With continued reference to FIG. 3A, it can be seen that the thickness of the wall portion 122 generally corresponds to that of the end 56 of curling punch 50. At its vertical upper extremity 124, the lower pressure pad 120 may be provided with a concave surface 125 into which the peripheral edge P of shell 5 is pressed by the curling punch 50, as best shown in FIG. 5A. The curvature of concave surface 125 may be similar to at least a portion of the curvature of tip 53 of curling punch 50 such that at least a portion of peripheral edge P, generally indicated at C, is firmly clamped between the curling punch 50 and lower pressure pad 120 with the remainder of the peripheral edge P being unrestrained. This unrestrained portion, will be referred to as free end F herein.

Figure 6:
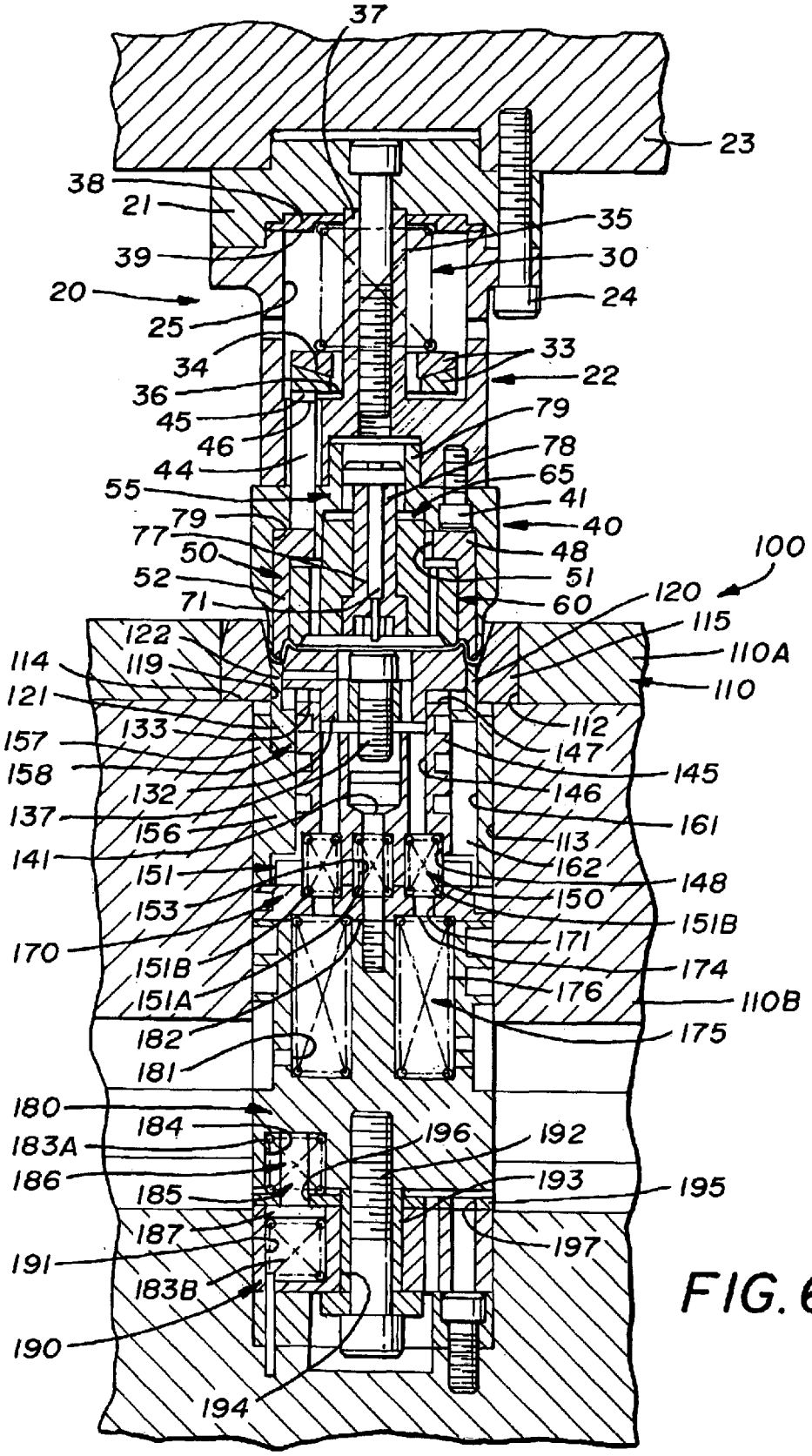
FIG. 6 is a sectional side elevational view similar to FIG. 5 shown at a later point in the operation of the rotary die curl assembly.
Figure 6A:
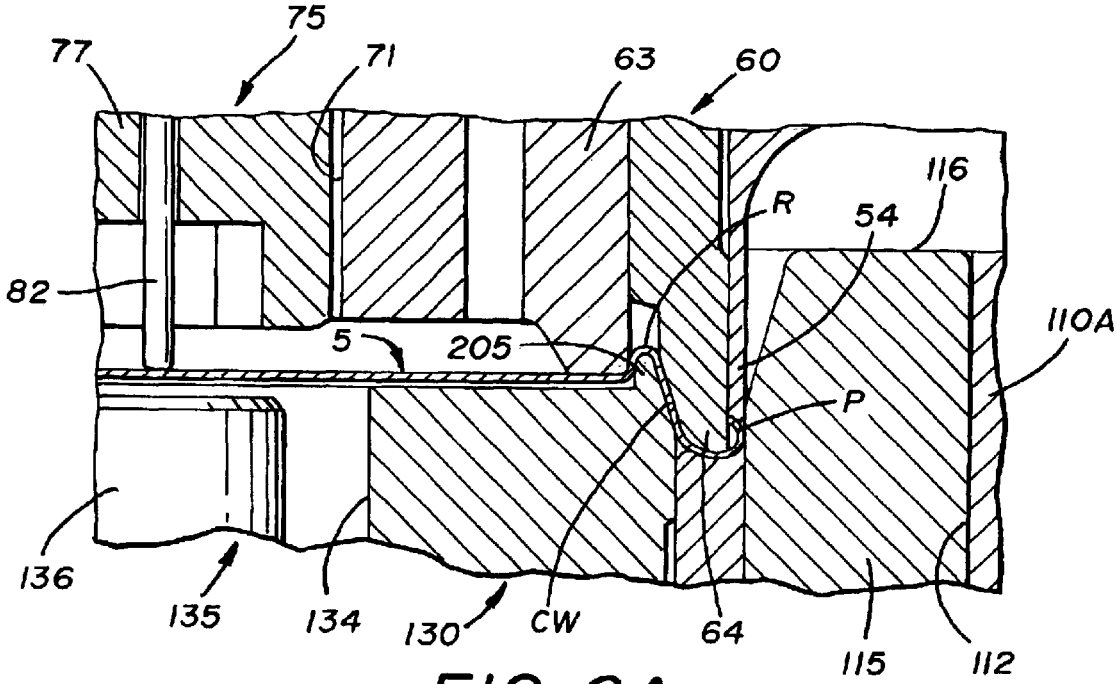
FIG. 6A is an enlarged view similar to FIG. 5A depicting the interface between the punch and die assemblies at the position shown in FIG. 6 showing details of the curl forming process and the commencement of the reforming phase.

As best shown in FIG. 5A, the curling punch 50 and lower pressure pad 120 contact each other across a radial portion less than the thickness of wall portion 122 with the remaining thickness of the wall portion 122 lying substantially beneath the end 54 of the punch holder 40. This end 54 defines a recess 127 adapted to receive the peripheral edge P and finish placing a curl on the peripheral edge P, as shown in FIG. 6A. The recess 127 may be defined by a concave surface, which may have a curvilinear or linear slope, that extends radially inward and axially upward from the outer surface 129 of end 54.

Returning to FIG. 3, a die core assembly, generally indicated by the numeral 130, is located radially interiorly of the lower pressure pad 120. Die core assembly 130 includes a shoulder portion 131 that substantially fills the area between the wall portion 122 of lower pressure pad 120. A collar portion 132 extends axially downward from the shoulder portion 131 at a point radially inward from the shoulder portion 131 defining a lower shoulder surface 133 that at least partially rests upon the base portion 121 of lower pressure pad 120. The upper portion 131 and lower portion 132 of die core 130 share a common interior surface 134 that defines a bore that receives a central sleeve assembly, generally indicated by the numeral 135 (FIG. 3A).

Sleeve assembly 135 may include a fastener having a cap 136 and shaft 137 that is attached to the die core assembly 130, as by a threaded sleeve 138 as shown in the example depicted in FIG. 3. The threaded sleeve 138 may have a generally U-profiled interior surface 139 that defines a similarly shaped bore having a central opening 141 at its lower extremity through which a shaft 137 passes. A die core spacer, generally indicated by the numeral 145, surrounds the sleeve assembly 135.

Die core spacer 145 has an inner surface 146 that defines a bore that receives sleeve assembly 135 and further accommodates the outwardly extending lower portion 132 of die core 130. The upper surface 147 of die core spacer 145 is initially located below the shoulder 133 of die core 130 providing a clearance for axial inward retraction of die core 130 during the forming process. At the lower vertical extremity of the die core spacer 145, die core spacer 145 is provided with an annular interior recess 148 that allows the die core spacer 145 to fit over a first biasing assembly, generally indicated by the numeral 150, which may include one or more coil springs 151. In the example shown, three springs 151 are depicted including a centrally located spring 151A that fits within a similar recess 153 formed in the sleeve assembly 135 and two springs 151B located radially outward of central spring 151A. Central spring 151A defines a bore that allows the shaft 137 of sleeve assembly 135 to pass therethrough and be fastened below. A die core sleeve, generally indicated by the numeral 155, resides radially outward of the die core spacer 145 and, in the radial sense, substantially fills the bore 113 of the die holder 110. Die core sleeve 155 may be somewhat T-shaped in section with axially extending flanges 157 at its upper and lower extremities that define recesses at 158 and 159. Upper recess 158 provides a clearance for retraction of the lower pressure pad 120. As shown in FIG. 3, die core sleeve 155 may also define an opening 161 on one side. In the example shown, a spring aligning pin 162 is received within opening 161 extending between lower pressure pad 120 and a die core riser, generally indicated by the numeral 165. Die core riser 165 fits within the recess 159 defined by die core sleeve 155 surrounding the spring assembly 150 and resting beneath the stem portion 156 and pin 162. Through interconnection with curling die 115 via die core sleeve 155, lower pressure pad 120 via pin 162, and die core 130 via die core spacer 145, die core riser 165 associates the movements of the die tooling, such that, they move as a unit and the shell specification is maintained.

A spring plate, generally indicated by the numeral 170, is located below the die core riser 165 and die core sleeve 155 and in supporting relation thereto. Spring plate 170 is provided with one or more axially extending openings 171 corresponding to the bores of spring assemblies 150, such that, members extending through the bores of the springs 151 may pass through the spring plate 170. The spring plate 170 may further be provided with one or more first recesses 173 along its top surface that may he used to locate the spring assemblies 150. Similarly, second recesses 174 may be formed in the lower portion of spring plate 170 to locate additional spring assemblies below the spring plate 170. In the example shown, a second spring assembly, generally indicated by the numeral 175, is located below the spring plate 170 and housed substantially within an upper spring holder, generally indicated by the numeral 180. As in the case of spring assembly 150, second spring assembly 175 may include a variety of spring members including coil springs 176, as shown. Further, as shown in the depicted example, a pair of spring assemblies 175 may be used and generally reside within recesses 181 defined within the upper spring holder 180. The springs 176 are sized such that they extend above the upper spring holder 180 and fit within recesses 174 on spring plate 170 to provide a clearance 182 between the spring plate 170 and upper spring holder 180.

At its lower extremity, upper spring holder 180 may be provided with a recess 184 in which a spacing assembly, generally indicated by the numeral 185, is at least partially seated. Spacing assembly. 185 may include at least one biasing member 183, such as, for example, a coil spring that is adapted to apply pressure to the upper spring holder 180 and a lower spring holder, generally indicated by the numeral 190. In the example shown, a spacing assembly 185 that includes a pair of biasing members 183 is employed. A locating member, generally indicated by the numeral 186 may be used to position the dual biasing members 183 with respect to each other and the upper and lower spring holders 180, 190. In the example shown, locating member 186 includes an annular flange 187 having a pin 188 extending axially outward from the flange 187 on either side, where the biasing members 183A, 183B are mounted on the pin 188.

Like upper spring holder 180, lower spring holder 190 defines a recess 191 that receives the lower spring 183B and is further sized to receive the flange 187. The lower chuck assembly 190 may be connected to the upper chuck assembly 180 as by a fastener 192. A bushing 193 may surround the fastener below the upper spring holder 180 and reside within a bore 194 defined within the lower spring holder 190. A spacer 195 is fit over the bushing 193 residing between the upper spring holder 180 and lower spring holder 190. Spring holder 195 defines a plurality of bores including an opening 196 for receipt of locator 186 and bores 197 and 198 correspond to similar bores formed in the lower spring holder 190 to form continuous through bores 197, 198 through both members.

The spacer 195 has an axial dimension less than the bushing 193, such that a gap, generally indicated at 200, is formed between the upper spring holder 180 and lower spring holder 190. This gap compensates for any thermal expansion of the die assembly 100. In particular, it will be seen that upper spring holder 180 is slideably fastened to lower spring holder by the fastener 197 and bushing 193 arrangement. This allows all of the die tooling to move together, in response to thermal expansion, and maintain the shell dimensions. By compensating for thermal expansion, the rotary die curl assembly 115 may operate continuously and maintain consistent tolerances of the formed shell 5. It has been observed that the effects of thermal expansion in previous designs have led to shells that fall outside of tolerance including shells that have brittle or weakened chuck walls that could lead to failure. Therefore, the present design overcomes this flaw reducing the number of shells that must be scrapped.

Figure 4:
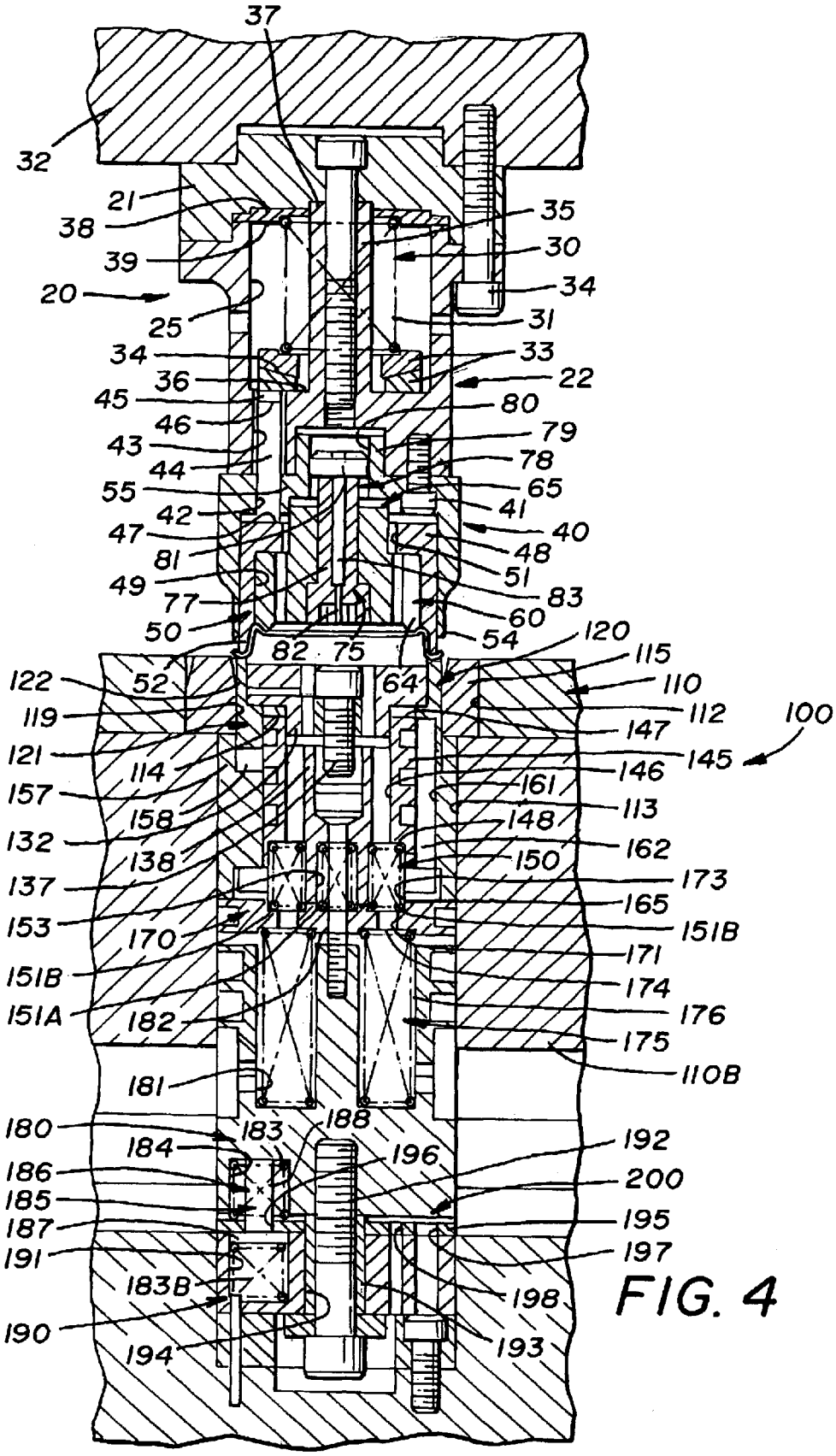
FIG. 4 is a sectional side elevational view similar to FIG. 3 depicting initial contact of the rotary die curl punch and die assemblies at the interface.
Figure 5:
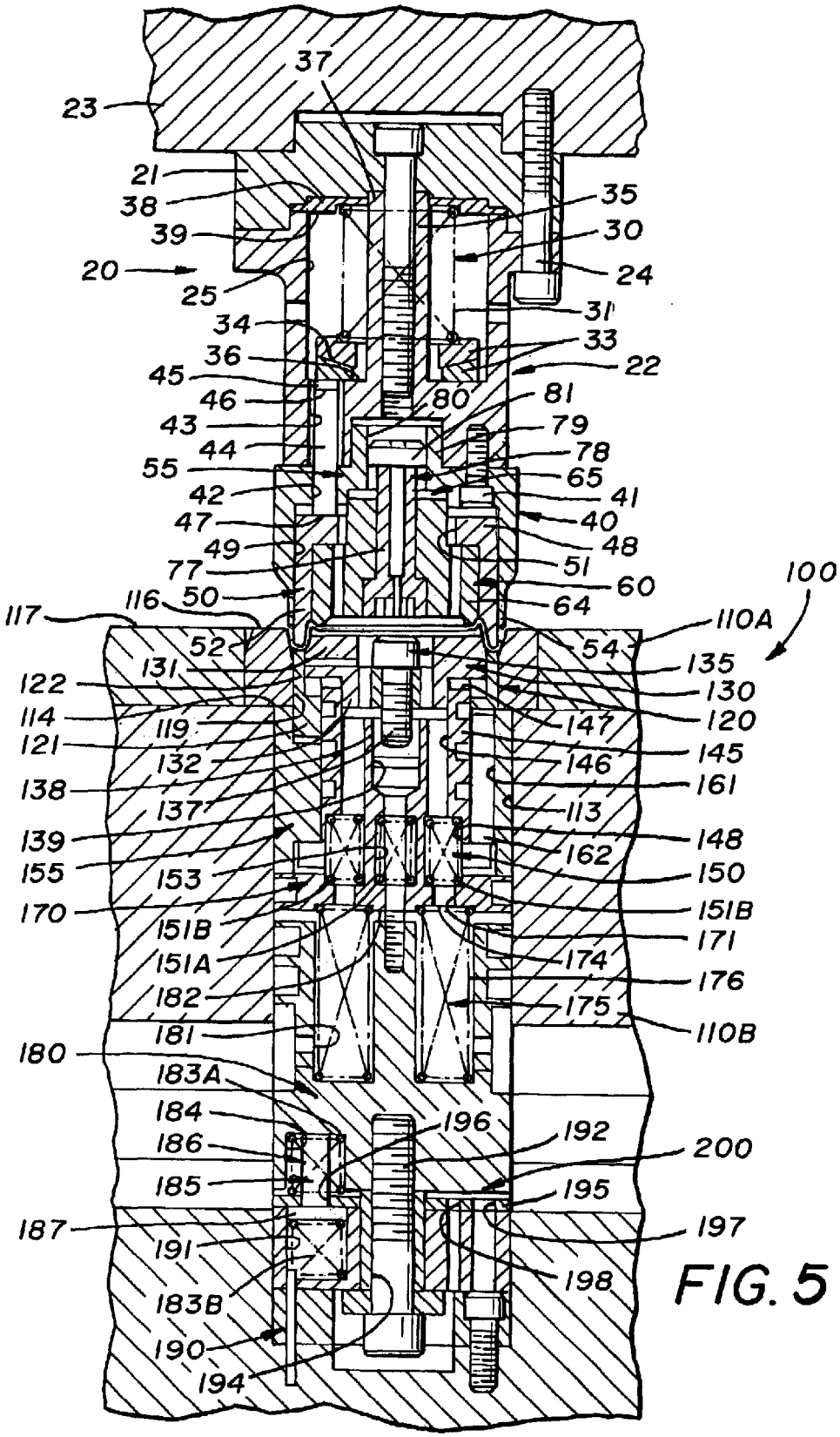
FIG. 5 is a sectional side elevational view similar to FIG. 4 depicting the rotary die curl assembly at a later point in the forming operation.
Figure 7:
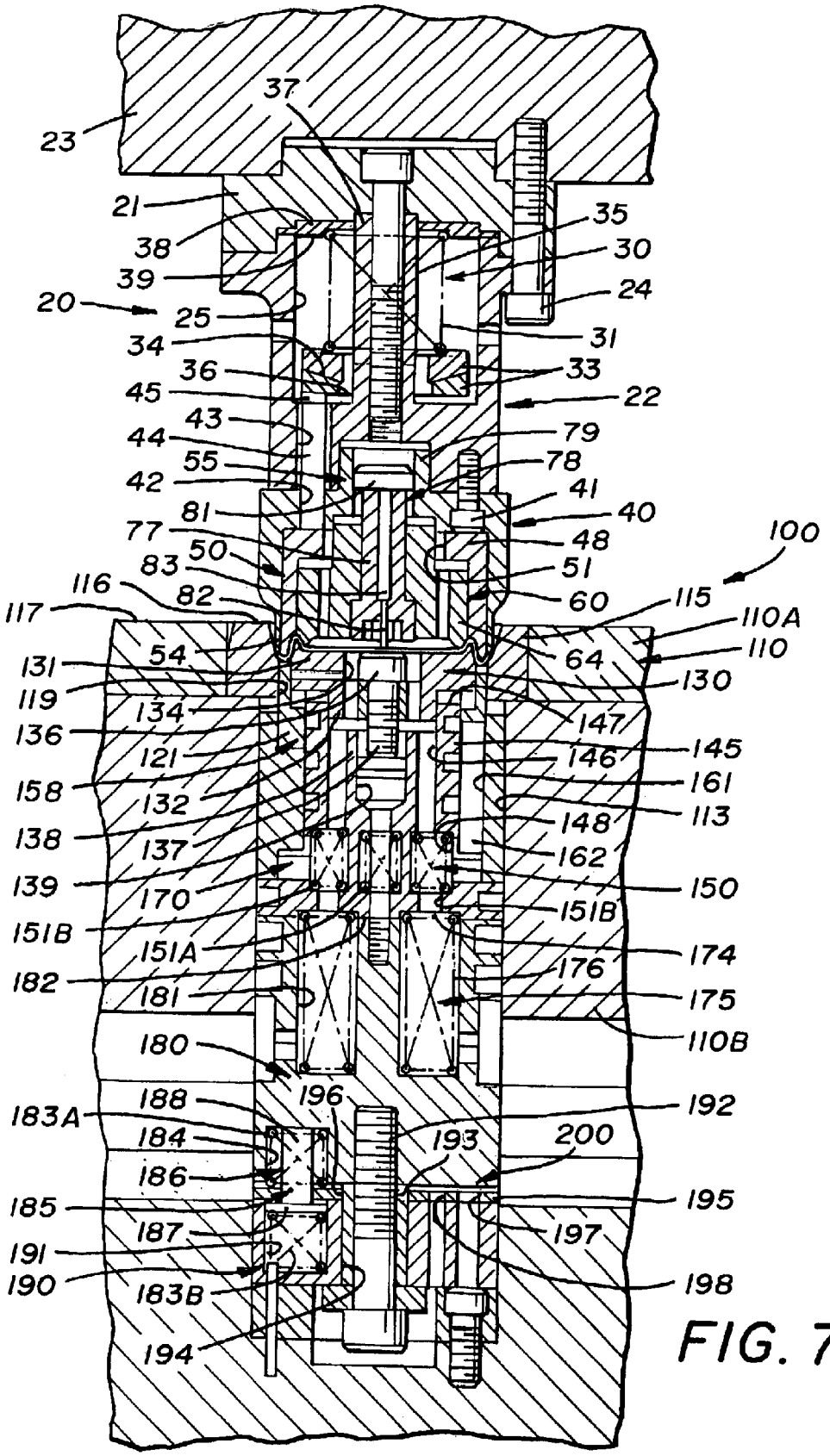
FIG. 7 is a sectional side elevational view similar to FIG. 6 depicting retraction of the halves and release of the shell.
Figure 8:
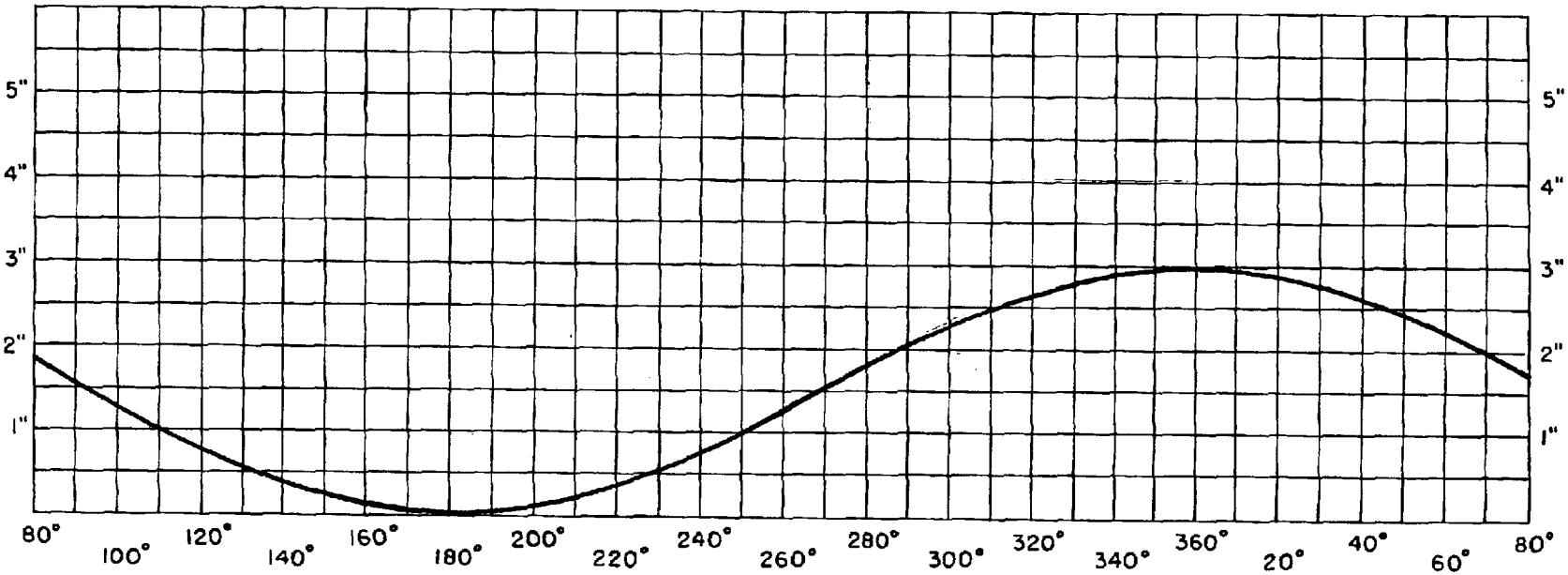
FIG. 8 is a chart graphically depicting the operational cycle of the rotary die curl assembly according to the concepts of the present invention with the axial location of the punch being express in terms of angular position.

Operation of the rotary die curl assembly 15 will now be described. As discussed previously, shells 5 are received within the rotary die curl assembly 15. The shell 5 may have been preformed, as depicted in FIG. 3, to include a ridge R, chuck wall CW and peripheral edge P, but, as will be appreciated by those of ordinary skill in the art, the shell 5 may arrive without such forming, and the shell 5 may be formed in the rotary die curl assembly 15. The operation of the press is cyclical and FIG. 8 graphically depicts the distance traveled by the punch assembly 20 in terms of the angular position of the linkage that drives punch assembly 20. FIG. 3 depicts the punch assembly 20 is an up position corresponding to the first point on the graph in FIG. 8. As can be seen, this point is the 80° position. In this position, the shell 5 is positioned on the die assembly 100. In the case of a preformed shell 5, as shown, the peripheral edge P is generally located above the lower pressure pad 120 extending slightly radially outward thereof and the rim R is located generally directly above a raised edge 205 that extends axially upward from the top surface 206 of die core 130. From this position, the punch 20 travels downwardly and initial contact is made by the curling punch 50 at approximately a 126.5° position. This contact occurs at the tip 53 of the curling punch 50 sandwiching the peripheral edge P between the curling punch 50 and the lower pressure pad 120. Downward travel of the punch assembly 20 continues with contact of the punch center 60 occurring very soon after curling punch contact. Subsequent to the curling punch and punch center contact, at an approximate 128.7° position, forming or reforming of the panel begins, as depicted in FIG. 4. As can be seen in FIG. 4, the curling punch 50 is in contact with peripheral edge P and the ridge R is received within recess 59 between the curling punch 50 and punch center 60 with the punch center 60 contacting the center panel CP at surface 67. Further, at this point, the clearance 158 below the lower pressure pad 120 is maintained. From this position, the punch assembly 20 continues to travel downwardly and at approximately a 140° position the die core 130 approaches contact with the shell 5 at its raised edge 205, as best shown in FIG. 5A. As shown in FIG. 5, which corresponds to the 140° position, the clearance 158 is reduced as the lower pressure pad 120 is driven downwardly by the curling press 50 drawing the shell 5 over the die core 130. As best shown in FIG. 5A, the tip 53 of curling punch 50 drives the peripheral edge P into the concave area 125 on lower pressure pad 120 causing the peripheral edge P to bend upwardly at its free end F positioning the terminus of the peripheral edge within the plane of the punch holder 40. As the punch assembly 20 continues downwardly, to a position depicted in FIGS. 6 and 6A, which corresponds approximately 167.5° in FIG. 8, the end 54 of punch holder 40 contacts the peripheral edge P to complete the formation of the curl. As best shown in FIG. 6A, the concavity 127 formed by the tip 54 of punch holder 40 causes the peripheral edge P to curl inwardly until it contacts the outside surface 58 of curling punch 50. From this position, the punch assembly 20 continues until it bottoms out in a position corresponding to FIG. 7, which is the 180° position in FIG. 8, where the shell 5 is curled and the panel is formed. Thermal expansion of the various components may cause the punch assembly 20 to over travel. The spring assemblies 30, 150, 175 and 185 absorb the shock created by the contacting of the punch assembly 20 and die assembly 100, and over travel is compensated for by the allowance for thermal expansion created by gap 200.

After the punch assembly 20 has bottomed out, the punch assembly 20 and die assembly 100 are forced away from each other from the inside out, as by the forces created by the spring assemblies 30, 150 and 175 until the curling punch 50 withdraws from contact with the lower pressure pad 120. As the punch assembly 20 and die assembly 100 part, the ejector pin assembly 75 frees the shell 5 from the punch assembly 20. In particular, the pin 82, which is compressed throughout the downward travel of the punch assembly 20, expands axially downwardly against the center plate CP of the shell 5. At a position generally corresponding to approximately 242.2°, the curling punch 50 clears the shell, which then may be conveyed from the rotary die curl assembly 15, as by a fluid or mechanical device including a belt, air jet, or mechanical kicker.

While a full and complete description of the invention has been set forth in accordance with the dictates of the patent statutes, it should be understood that modifications can be resorted to without departing from the spirit hereof or the scope of the appended claims.

What is claimed is:

1. A rotary die curl assembly comprising: a punch assembly and a die assembly axially aligned and selectively engageable with each other;

said punch assembly including a punch holder mounted on a punch center, said punch holder having an annular end that extends toward said annular die assembly, said end having an axially inward and radially inward extending tip;

a curling punch received within said punch holder; and a punch core mounted within said curling punch including an axially extending periphery adjacent said curling punch defining a recess therebetween;

wherein said curling punch extends axially outward of said punch holder and said punch core;

said die assembly including a a die holder and a curling die received within said die holder, said curling die defining a bore;

a lower pressure pad mounted within said bore and slideable relative to said curling die; and a die core located within said lower pressure pad, said die core having a raised edge located beneath the recess in said punch assembly;

an upper spring holder located below said curling die, said lower pressure pad, and said die core supporting at least one of said curling die, lower pressure pad and die core; and a lower spring holder located below said upper spring holder and held in spaced relation by a spacing assembly defining a gap between said upper spring holder and said lower spring holder, whereby thermal expansion of either of the punch assembly or die assembly is compensated for by said spacing assembly and said gap.

2. The rotary die curl assembly of claim 1, wherein said spacing assembly includes a recess defined in said lower spring holder, a spring received within said recess and a locating member having a pin extending upwardly from a radially extending flange, wherein said radially extending flange contacts said spring and said pin extends upwardly to contact said upper spring holder.

3. The rotary die curl assembly of claim 2, wherein said upper spring holder defines a recess into which said pin is received, and a second spring mounted on said pin and located within said recess.

4. The rotary die curl assembly of claim 3 further comprising a spacer located within said gap and defining a bore through which said pin extends, wherein said second spring is compressed between said spacer and said recess in said upper spring holder.

5. An apparatus for forming a container shell from material fed into a press comprising:

at a single station, tooling for curling the shell and tooling for reforming the shell including a punch assembly and a die assembly carried by the press and adapted to curl and reform the shell in a single stroke;

wherein said tooling for curling the shell includes a curling punch having a curved tip and a lower pressure pad located opposite said curling punch relative to the material and having a concave upper surface adapted to receive said tip; and wherein said tooling for curling the shell further comprises a punch holder located radially outward of said curling punch having an end that extends axially to a lesser extent than the curling punch tip, said end being located adjacent the outer surface of said curling punch, said end having a concave surface defining a recess between the outer surface of said curling punch and said end of said punch holder.

6. The apparatus of claim 5, wherein said tooling for curling the shell further includes a curling die located concentrically with the lower pressure pad and radially outward thereof, said curling die having a sloped interior surface extending axially downward and radially inward relative to the material defining a clearance adjacent the lower pressure pad for receipt of at least a portion of said punch holder.

7. The apparatus of claim 6, wherein said lower pressure pad is slidably received within said curling die.

8. The apparatus of claim 5, wherein said tooling for forming the shell includes a punch core located radially inward of the curling punch and having an outer surface spaced inwardly of an inner surface of said curling punch to define a ridge forming recess therebetween, and a die core located opposite said punch core having a raised annular rim receivable within said ridge forming recess, wherein said die core is located radially inward of said lower pressure pad and fixed relative thereto.

9. The apparatus of claim 8, wherein said die holder, said lower pressure pad, and said die core are supported on an upper spring holder, said upper spring holder being supported in spaced relation to a lower spring holder by a spacing assembly, wherein expansion of said tooling urges said upper spring holder toward said lower spring holder while maintaining a selected tolerance at said tooling.

10. The apparatus of claim 9, wherein said spacing assembly includes a spring extending between said upper spring holder and said lower spring holder.

11. The apparatus of claim 9, wherein said biasing assembly includes a first recess defined in said upper spring holder and a second recess formed in said lower spring holder, said recesses being located on a common axis and opposite each other, a spring assembly located within said recesses extending between said upper spring holder and said lower spring holder.

12. The apparatus of claim 11, wherein said spring assembly includes a first spring housed within said recess formed in said lower spring holder, a locator having a radially extending flange received within said recess in said lower spring holder and supported on said first spring, and a second spring mounted on a pin extending from said locator member and being at least partially received within said recess formed in said upper spring holder.

13. The apparatus of claim 12 further comprising spacer supported on said lower spring holder beneath said upper spring holder and defining a bore adapted to slidably receive said pin on said locating member.

14. The apparatus of claim 9, wherein said upper spring holder and lower spring holder are interconnected by a fastener extending between said upper spring holder and lower spring holder and affixed at one end to either of said upper spring holder or lower spring holder, said fastener being slidably received within the other of said upper spring holder or lower spring holder to allow relative movement between said upper spring holder and lower spring holder in response to thermal expansion of the tooling.

15. The apparatus of claim 14, wherein said fastener is received within a bushing extending through the other of said upper spring holder and lower spring holder into said gap.

16. The apparatus of claim 5, wherein said tooling includes a punch assembly and a die assembly held in opposed relation to each other, said punch assembly including a punch holder mounted on a center post, wherein said center post defines an internal cavity in which a first biasing assembly is received; a curling punch carried on said center post and slidably received within said punch holder and selectively interconnected with said biasing assembly.

17. The apparatus of claim 16, wherein said center post defines a bore extending between said first biasing assembly and said curling punch, and a pin received within said bore and having a length less than that of said bore, whereby said pin interconnects said first biasing assembly and said curling punch upon said curling punch driving said pin into contact with said first biasing assembly.

18. The apparatus of claim 17, wherein said punch assembly further includes a punch core received within said curling punch, said punch core being interconnected with said curling punch such that said first biasing assembly absorbs any expansion of said punch core.

19. The apparatus of claim 18, wherein said punch core defines a bore receiving an ejector assembly mounted therein, said ejector assembly being adapted to eject the shell after operation of said tooling.

20. The apparatus of claim 5, further comprising an ejector assembly provided on either of said punch assembly and die assembly, said ejector assembly being adapted to eject the shell from said punch and die assemblies after curling and forming has occurred.

* * * * *